US005350110A

United States Patent [19]

Will

[11] Patent Number: 5,350,110

[45] Date of Patent: Sep. 27, 1994

[54] LIQUID CONTAINER AND A METHOD OF MAKING SAME

[76] Inventor: Wilhelm Will, Breite Hecke 7, 4670 Lunen, Fed. Rep. of Germany

[21] Appl. No.: 39,117

[22] PCT Filed: Jul. 29, 1992

[86] PCT No.: PCT/EP92/01717

§ 371 Date: May 27, 1993

§ 102(e) Date: May 27, 1993

[87] PCT Pub. No.: WO93/02931

PCT Pub. Date: Feb. 18, 1993

[30] Foreign Application Priority Data

Aug. 7, 1991 [DE] Fed. Rep. of Germany ..... 9109758

[51] Int. Cl.[5] ..... B65D 43/14

[52] U.S. Cl. ..... 229/125.15; 53/456; 229/137; 220/461; 220/463

[58] Field of Search ..... 229/125.04, 125.15, 229/132, 137, 138; 220/403, 404, 460, 461, 462, 463, 465, 441; 53/575, 456, DIG. 2

[56] References Cited

U.S. PATENT DOCUMENTS

| | | | |
|---|---|---|---|
| 4,145,236 | 3/1979 | Neumayer et al. | 53/DIG. 2 X |
| 4,279,375 | 7/1981 | Gardner | 229/138 X |
| 4,572,422 | 2/1986 | Heuberger et al. | 220/461 |
| 4,860,902 | 8/1989 | Kieser | 53/DIG. 2 X |
| 4,862,680 | 9/1989 | Krah | 53/575 |
| 4,911,306 | 3/1990 | Lisiecki et al. | 229/137 X |
| 5,069,385 | 12/1991 | Farber | 229/137 |
| 5,110,040 | 5/1992 | Kalberer et al. | 53/DIG. 2 X |
| 5,114,069 | 5/1992 | Detzel et al. | 229/125.15 |
| 5,176,313 | 1/1993 | Curry et al. | 220/403 X |

FOREIGN PATENT DOCUMENTS

| | | |
|---|---|---|
| 2704515 | 8/1977 | Fed. Rep. of Germany . |
| 3336269 | 4/1985 | Fed. Rep. of Germany . |
| 3800883 | 7/1989 | Fed. Rep. of Germany . |
| 4015119 | 1/1991 | Fed. Rep. of Germany . |
| 9103401 | 3/1991 | World Int. Prop. O. . |

*Primary Examiner*—Allan N. Shoap
*Assistant Examiner*—Christopher McDonald
*Attorney, Agent, or Firm*—Harris Beach & Wilcox

[57] ABSTRACT

A liquid container made from a blank of a foldable and liquid tight sheet material, preferably a plastic coated carton, comprising top, bottom, front, rear and side walls, a longitudinally extending connecting flap for preclosing said blank to form a tubular portion, an inclined wall disposed between said top and front walls and including a spout which is connected to said side walls via first triangular folding segments each having a tip which substantially merges with a folding line between said front wall and said inclined wall, said top wall is connected to said side walls via further folding segments of which internal folding segments extend from said top wall and include folding lines aligned with the folding lines of said first triangular folding segments when the blank is flat and are connected to said first triangular folding segments via folding lines extending substantially parallel to the folding line between said inclined wall and said top wall in the finished container, second triangular folding segments are disposed between said internal folding segments and said side walls and have tips which also merge substantially with the connecting line between the inclined wall and the top wall of the finished container, said folding segments are folded inwards, and said top wall includes a top flap for connection to said back wall.

12 Claims, 3 Drawing Sheets

LIQUID CONTAINER AND A METHOD OF MAKING SAME

BACKGROUND OF THE INVENTION

1. Field of the Invention

The subject of the invention is a liquid container and a method of making same in accordance with the preambles of claims 1 and 7.

2. Description of the Prior Art

The liquid container is suitable for food products, however is primarily intended to be used in the non-food field. In particular it is intended to be used for liquid detergents and softeners, the container being of a shape different from that of conventional food containers, so as to provide for clear distinction characteristics.

A great variety of liquid containers of carton of rectangular or square shape including various opening characteristics have become known. They are for example modifications of the conventional hard carton containers for milk and juices which include a gusset to be torn for opening the container. With such containers pouring is difficult to control, and handling thereof may be a problem. Furthermore, reclosing thereof is possible only in a very restricted manner. The last-mentioned drawback is present also in containers that can be opened by tearing the seam at a specific location of the top.

Furthermore, there are liquid containers of various shapes and made from carton which include a spout adapted to be reclosed and connected to an internal pouch. DE-C2-33 36 269 discloses such an internal pouch container which has the spout with a threaded closure disposed on an inclined wall between the top and front walls. This allows for a controlled pouring via the inclined wall of the top and provides for reclosing characteristics. However, making of such an internal pouch container is cumbersome.

DE-C2-40 15 119 discloses a liquid container including a gusset in a corner area between a top wall and a front wall. The gusset includes a spout or adapter on an inclined wall. For closing of the container top, top wall portions are folded from side walls onto folding segments which connect the inclined wall and a flap connected thereto with the side walls. Furthermore, the flat top in the gusset area is closed by a seam. The method of making this container provides that the spout is applied to the inclined wall before or after the filling operation, in particular when the bottom has been closed, or before the filling operation when the opening is not covered in particular before the inclined wall has been folded inwards and in particular after the gusset has been closed. The making of this container is relatively cumbersome in particular due to the necessary folding and sealing of the top and application of the spout.

In view of the above it is an object of the present invention to provide a liquid container of the above-mentioned type, the making of which is simplified by suitable structure of the top. Furthermore, a simplified method of the above-mentioned type is to be provided.

SUMMARY OF THE INVENTION

In one aspect of the invention a liquid container made from a blank of a foldable and liquid tight sheet material, preferably a plastic coated carton, comprising top, bottom, front, rear and side walls, a longitudinally extending connecting flap for preclosing the blank to form a tubular portion, an inclined wall disposed between the top and front walls and including a spout which is connected to the side walls via first triangular folding segments each having a tip which substantially merges with a folding line between the front wall and the inclined wall, characterized in that the top wall is connected to the side walls via further folding segments of which internal folding segments extend from the top wall and include folding lines aligned with the folding lines of the first triangular folding segments when the blank is flat and are connected to the first triangular folding segments via folding lines extending substantially parallel to the folding line between the inclined wall and the top wall in the finished container, that second triangular folding segments are disposed between the internal folding segments and the side walls and have tips which also merge substantially with the connecting line between the inclined wall and the top wall of the finished container, that the folding segments are folded inward, and that the top wall includes a top flap for connection to the back wall.

In another aspect of the invention the back wall includes a connecting flap which is pivotally connected, via triangular folding segments, to the rearward ends of second triangular folding segments pivotally connected to the side walls, and that the connecting flap and the third triangular folding segments are folded inward.

In a further aspect of the invention the internal folding segments, the second triangular folding segments and/or the third triangular folding segments extend at least adjacent the back wall substantially to the center thereof.

In yet another aspect of the invention the internal folding segments and/or the second triangular folding segments at their ends include recesses in the area of the folding lines connecting them to each other.

The folding segments are sealed to each other at their surfaces abutting each other and abutting the inclined wall, the top wall and the connecting flap.

The spout has a sealed flange engaging the inclined wall from behind.

In a method of making the container in accordance with the invention the blank is sealed to form a tubular portion, its top is formed and sealed on a mandrel by means of tools, the spout is inserted into the inclined wall and is sealed thereto, the container is filled with liquid from its bottom and the bottom of the container is closed, characterized in that the spout with the mandrel is inserted into the inclined wall and is sealed to the inclined wall before the container formed and sealed at its top is withdrawn from the mandrel.

In still another aspect of the invention, sealing is performed on the mandrel by means of hot air and ultrasonic energy.

In a liquid container of the present invention said first triangular folding segments seal said inclined wall against the sidewalls. Said further folding segments provide for sealing between the top wall and the side walls, the rectangular folding segments providing for a sealing action also towards said first triangular folding segments, and said second triangular folding segments connect the quadrangular folding segments to the side walls. It is to be understood that said further folding segments extend along the side walls such that no liquid can escape between the top and side walls. The inwardly folded folding segments are not noticeable with the finished container and form substantial sealing surfaces. The making of the container when the folding line is properly preformed is very easy, in particular because the inclined and top walls and the top flap are to be folded merely in a common direction. Preferably, the back wall is connected to said second triangular folding sections at the side walls via a connecting flap and third triangular folding seg-ments, whereby the sealing between the top wall and the back wall is improved. This is so because the inwardly folded further folding segments may be sealed to each other and to the top wall and the connecting flap such that at most a small gap remains in the center, which gap is covered by the top flap. To this end, it is particularly advantageous if the folding segments directed to the back wall extend adjacent the back wall at least substantially to the center thereof. With containers having narrow back and front walls, an interference of folding segments folded inwards from different sides is avoided if they at their ends include recesses in the area of folding lines connecting them. The fluid tight seal is further improved by substantial surface sealing of the folding segments to each other and to the inclined wall, the top wall and the connecting flap. Application of the spout will be particularly advantageous if the spout has a sealed flange engaging the inclined wall from behind. It is to be understood that the spout may be adapted to be reclosed and may include e.g. a threaded closure to this end. At its bottom, the container may be sealed by conventional gusset seal means as known for example from DE-A1-27 04 515.

A liquid container in accordance with the present invention which may be made from a single carton blank has the advantage of being adapted to be easily opened and reclosed and of allowing for controlled pouring through the inclined top side. Furthermore, a flat top wall provides for good piling characteristics saving transporting and storing space. When the container has been emptied, it can be reformed into a flat member by opening the top and destroying part of the bottom closure so as to alleviate the waste problem. The necessity of tearing the container into individual parts is eliminated.

According to the method of the present invention, application of the spout is simplified by insertion thereof with the mandral and simultaneous sealing of the top. The spout may be inserted as a complete unit into an opening of the inclined wall during forming of the top. The method is simplified by the shape of the container blank and the folding procedure determined thereby. It may be realized in the packing machine. When the sealing is performed by means of ultrasonic energy, a plastic layer of the sheet material and a plastic flange of the spout are plastified and connected to each other.

Further details and advantages of the subject matter of the present invention may be seen from the following description and the accompanying drawings showing two preferred embodiments. In the drawings:

DESCRIPTION OF THE PREFERRED EMBODIMENT

Figure 1:
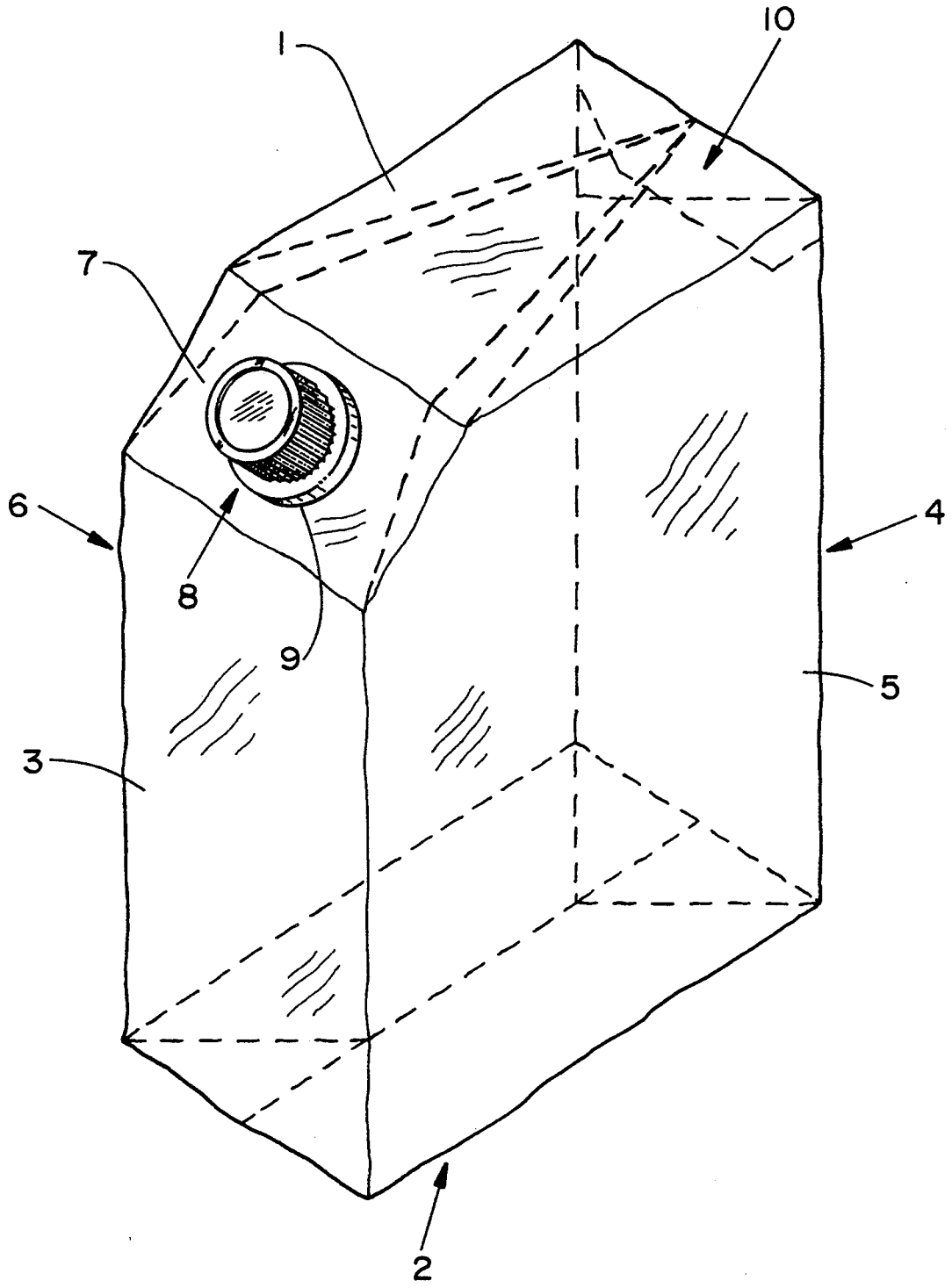
FIG. 1 is a perspective view from above of a finished liquid container.

Referring to FIG. 1, a liquid container in accordance with the present invention includes a top wall 1 and a bottom wall 2 parallel thereto. Furthermore there are a front wall 3 and a back wall 4 which also are parallel to each other and perpendicular to the top and bottom walls 1, 2. Furthermore, side walls 5, 6 are parallel to each other and perpendicular both to the top and bottom walls 1, 2 and the front and back walls 3, 4.

An inclined wall 7 which is inclined with respect to the vertical e.g. about 30° extends between the top wall 1 and the front wall 3. The inclined wall 7 includes a spout 8 comprising a threaded closure 9.

In the top area of the liquid container there are indicated dotted folding lines associated with folding segments and a connecting flap as will be explained in more detail in the following description of the blanks. The top wall 1 includes a connecting flap 10 also indicated by dotted lines and arranged for connection to the back wall 4. At the bottom wall 2 there are indicated by dotted lines triangular end closure flaps which also will be described in more detail later on.

Figure 2:
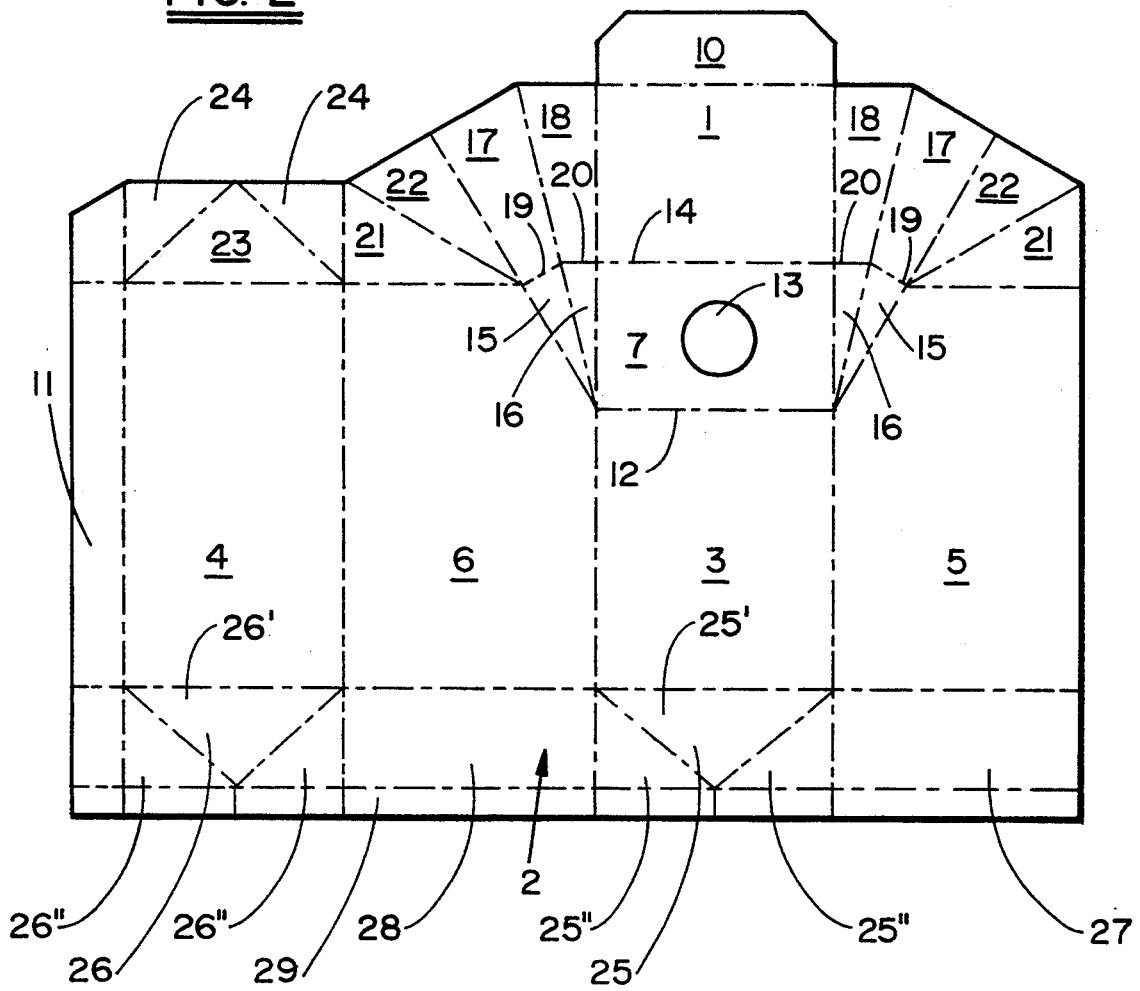
FIG. 2 is a flat blank of the same liquid container.
Figure 4:
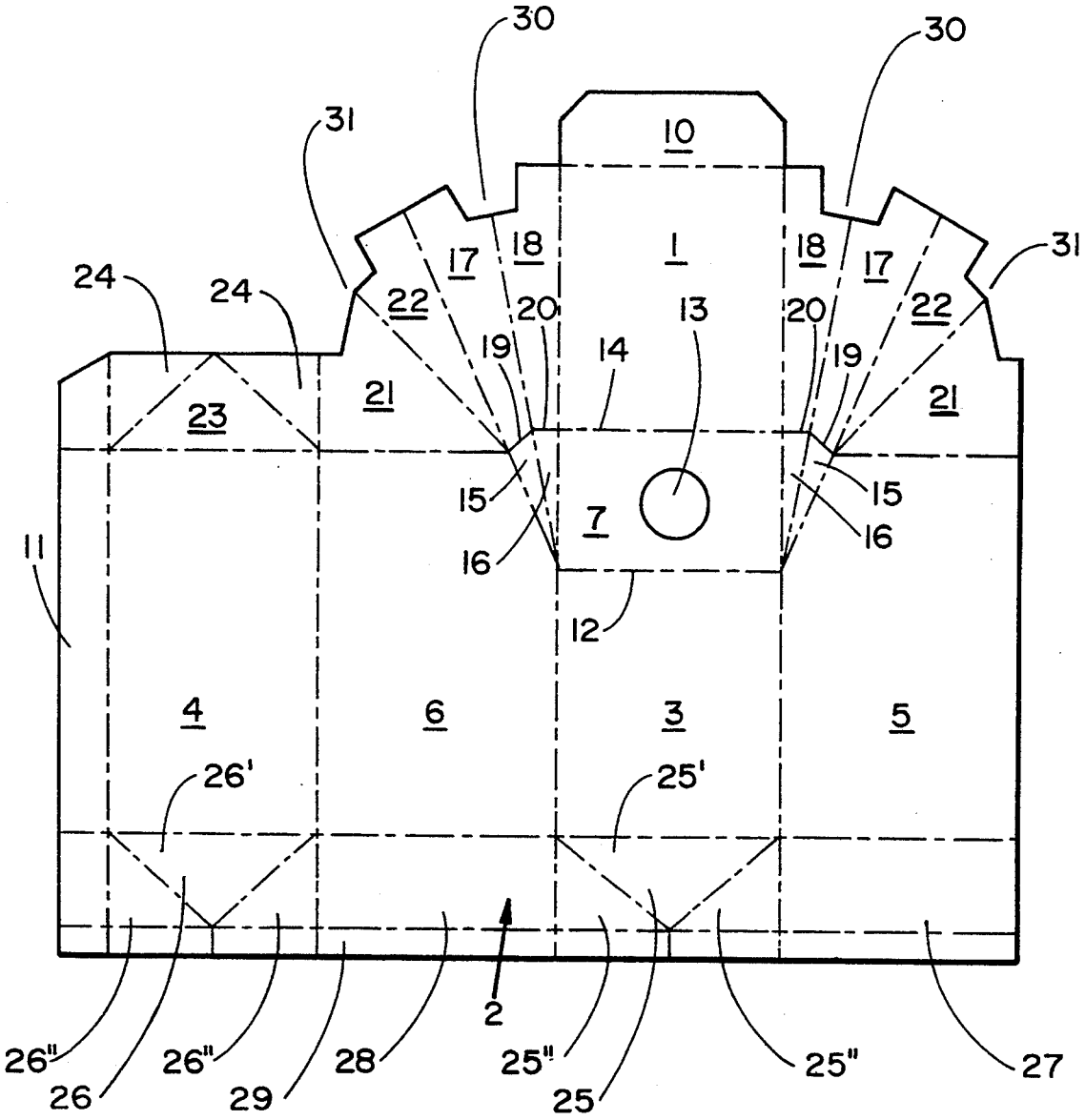
FIG. 4 ist a flat blank of a narrower liquid container.

From the flat blanks in FIG. 2 and 4 it may be seen that back wall 4, side wall 6, front wall 3 and side wall 5 are connected to each other by folding lines. The blank in FIG. 4 has narrower front and back walls 3, 4 than the blank in FIG. 2. In both cases the back wall 4 is connected via a further folding line to a connecting flap 11 by means of which the blank may be sealed in the edge area of the side wall to form a tubular portion.

The inclined wall 7 which includes a hole 13 for receiving the spout 8 is pivotally connected to the front wall 3 by means of a folding line 12. The inclined wall 7 is connected via a further folding line 14 to the bottom wall 1 which at its other end includes the top flap 10.

A pair of first triangular folding segments 15, 16 is disposed between the inclined wall 7 and each of the side walls 5, 6. The tips of the first folding segments 15, 16 merge with the folding line 12 of the front wall 3 and the inclined wall 7.

Between the top wall 1 and the side walls 5, 6 there are disposed further folding segments of which inner folding segments 17, 18 include folding lines aligned with the folding lines of the first folding segments 15, 16. Further, the internal folding segments 17, 18 are connected via folding lines 19, 20 to the first folding segments 15, 16, the folding lines 19, 20 being arranged so that they extend in parallel relationship with respect to folding line 14 between inclined wall 7 and top wall 1 in the finished container.

Said further folding segments include second triangular folding segments 21, 22 which connect the internal folding segments 17 to the side walls 5, 6.

The back wall 4 includes a triangular connecting flap 23 to which third triangular folding segments 24 are pivotally connected. The folding segments 24 are connected or connectible to the second folding segments 21 on the one hand directly and on the other hand via the connecting flap 11.

When the blank has been formed into a tubular portion, its top may be closed by folding inclined wall 7, top wall 1 and top flap 10 towards the back wall. In this operation all folding segments are folded inwards, with the visible outer side of the folding segments 15 and 16, 17 and 18, 21 and 22 abutting each other and the folding segments 24 being urged against the outer side of the connecting flap 23. In particular, in these abutment areas a sealing operation is performed. Further sealing areas are provided between the internal surfaces of the folding segments 16 and inclined wall 7, folding segments 18 and top wall 1, folding segments 17 and 22 as well as folding segments 21 and 24.

The bottom closure of the container is formed as a gusset sealing closure in a conventional manner. To this end, the front and back walls 3, 4 at their bottoms are provided with end closure flaps 25, 26, and the side walls 5, 6 are provided with side closure flaps 27, 28. A small sealing flap 29 extends across the end closure flaps 25, 26 and the side closure flaps 27, 28 close to the edge of the blank. The end closure flaps 25, 26 each are divided into a central and a pair of outer triangular folding segments 25', 26' and 25'', 26''.

Figure 3:
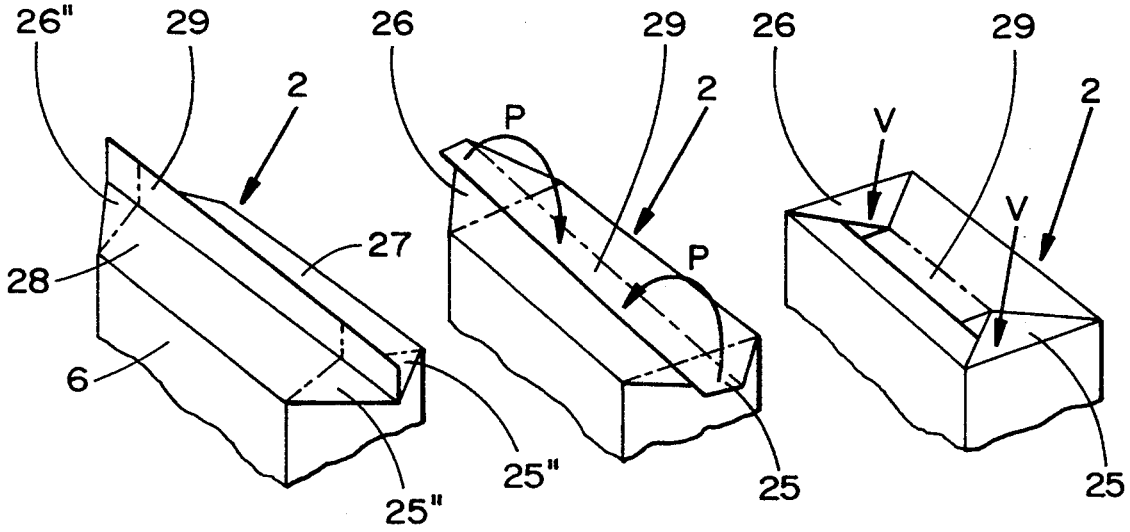
FIG. 3 shows the closing of the bottom closure of the same container in three steps.

FIG. 3 in the left hand sketch shows that when the blank has been folded into a tube-like portion, initially the side closure flaps 27, 28 are folded across the bottom opening, the outer folding segments 25'', 26'' coming into contact with the associated central folding segments 25', 26', and the portions of the sealing flap 29 come into abutting contact with each other between the tips of the two central folding segments 25', 26'. The sealing flap portions 29 are sealed to each other in this condition and when sealed are folded against the container bottom. This is shown in the central sketch of FIG. 3 from which it may be seen that the cantilevered triangular end closure flaps 25, 26 are folded against the container bottom in the direction of arrow P.

The final position of end closure flaps 25, 26 is shown in the right hand sketch of FIG. 3. When they are in this position, they are urged in the direction of sealing arrows F in order to be sealed to the bottom of the container.

The blank in FIG. 4, due to its narrower front and back walls 3, 4, has recesses 30, 31 at the folding lines between the internal folding segments 17, 18 and the second folding segments 21, 22, which recesses allow for interengagement of the further folding segments when they are folded inwards.

I claim:

1. A liquid container made from a blank of a foldable and liquid tight sheet material, comprising top, bottom, front, rear and side walls, a longitudinally extending connecting flap for preclosing said blank to form a tubular portion, an inclined wall disposed between said top and front walls and including a spout which is connected to said side walls via first triangular folding segments, each of said first triangular folding segments having a tip which substantially merges with a first folding line between said front wall and said inclined wall, characterized in that said top wall is connected to said side walls via further folding segments of which internal folding segments extend from said top wall and include second folding lines aligned with third folding lines of said first triangular folding segments when the blank is flat, and are connected to said first triangular folding segments via fourth folding lines extending substantially parallel to a folding line between said inclined wall and said top wall in the finished container, that second triangular folding segments are disposed between said internal folding segments and said side walls and have tips which also merge substantially with the connecting line between the inclined wall and the top wall of a finished container, that said first triangular folding segments, said further folding segments, and said second triangular folding segments are folded inwardly, and that said top wall includes a top flap for connection to said back wall.

2. The container in accordance with claim 1, wherein said sheet material is plastic coated.

3. A liquid container in accordance with claim 1, wherein said back wall includes a connecting flap which is pivotally connected via third triangular folding segments, to rearward ends of said second triangular folding segments, pivotally connected to said side walls, and that said connecting flap and said third triangular folding segments are folded inward.

4. A liquid container in accordance with claims 1, 2, or 3, wherein said internal folding segments, and at least one of said second triangular folding segments and said third triangular folding segments extend at least adjacent said back wall substantially to the center thereof.

5. A liquid container in accordance with claim 1, 2, or 3, wherein at least one of said internal folding segments and said second triangular folding segments includes opposed marginal recessed cutouts at their ends proximate a said second folding line.

6. A liquid container in accordance with claim 1, 2 or 3, characterized in that said said first triangular folding segments, said further folding segments, said second triangular folding segments, and said third folding segments are sealed to each other at their surfaces abutting each other and at their respective abutments with said inclined wall, said top wall and said connecting flap.

7. A liquid container in accordance with claim 1, 2, or 3, wherein said spout has a sealed flange engaging said inclined wall from behind.

8. A liquid container in accordance with claim 1, 2, or 3, wherein said flat top wall and said bottom wall are dimensioned for stacking with similar liquid container.

9. A method of making a liquid container, comprising the steps of:

providing a blank of a foldable and liquid tight sheet material, comprising top, bottom, front, rear and side walls, a longitudinally extending connecting flap for preclosing said blank to form a tubular portion, an inclined wall disposed between said top and front walls which is connected to said side walls via first triangular folding segments, each of said first triangular folding segments having a tip which substantially merges with a first folding line between said front wall and said inclined wall, characterized in that said top wall is connected to said side walls via further folding segments of which internal folding segments extend from said top wall and include second folding lines aligned with third folding lines of said first triangular folding segments when the blank is flat, and are connected to said first triangular folding segments via fourth folding lines extending substantially parallel to a folding line between said inclined wall and said top wall in said finished container, that second triangular folding segments are disposed between said internal folding segments and said side walls and have tips which also merge substantially with the connecting line between the inclined wall and the top wall of a finished container, that said first triangular folding segments, said further folding segments, and said second triangular folding segments are folded inwardly, and that said top wall includes a top flap for connection to said back wall;

sealing said connecting flap to an opposite end of said blank to form a tubular portion;

inserting a mandrel through said inclined wall;

while said mandrel is inserted performing the steps of:

sealing said top wall to said side wall and said rear wall to form a partially formed container having a sealed top surface on said tubular portion; and inserting a spout onto said mandrel into sealing engagement with said inclined wall;

thereafter filling said partially formed container with a liquid through an open bottom portion thereof; and closing said open bottom portion of said filled partially formed container.

10. The method in accordance with claim 9, wherein said back wall includes a connecting flap and said step of step of sealing said top wall comprises the steps of:

pivotally connecting said connecting flap via third triangular folding segments, to rearward ends of said second triangular folding segments, and to said side walls; and folding said connecting flap and said third triangular folding segments inward.

11. The method in accordance with claim 9 or 10, further comprising the step of coating said sheet material with plastic.

12. The method in accordance with claim 9 or 10, characterized in that said steps of sealing are performed with hot air and ultrasonic energy while said mandrel is inserted.

* * * * *